US005857287A

United States Patent [19]

Schield et al.

[11] Patent Number: 5,857,287

[45] **Date of Patent: *Jan. 12, 1999**

[54] METHODS AND COMPOSITIONS FOR IMPROVEMENT OF LOW TEMPERATURE FLUIDITY OF FUEL OILS

[75] Inventors: John A. Schield, Chesterfield, Mo.; Jerry J. Weers, Richmond, Tex.

[73] Assignee: Baker Hughes Incorporated, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 928,289

[22] Filed: Sep. 12, 1997

[51] Int. Cl.[6] ..... C10L 1/18

[52] U.S. Cl. ..... 44/395; 44/403

[58] Field of Search ..... 44/395, 393, 403

[56] References Cited

U.S. PATENT DOCUMENTS

| | | | |
|---|---|---|---|
| 4,153,422 | 5/1979 | Wisotsky | 44/395 |
| 4,240,916 | 12/1980 | Rossi | 508/306 |
| 4,481,013 | 11/1984 | Tack et al. | 44/394 |
| 4,652,611 | 3/1987 | Kuroda et al. | 44/393 |
| 5,441,545 | 8/1995 | Lewtas et al. | 44/395 |
| 5,478,368 | 12/1995 | Lewtas et al. | 44/395 |
| 5,503,645 | 4/1996 | Jung et al. | 44/395 |

*Primary Examiner*—Jacqueline V. Howard
*Attorney, Agent, or Firm*—Howell & Haferkamp, L.C.

[57] ABSTRACT

Adding to a fuel oil a composition of from about 1 to about 40 parts by weight ethylene/vinyl acetate copolymer having a vinyl acetate content of from about 10% by weight to about 50% by weight and a weight average molecular weight of from about 2,000 to about 10,000, and 1 part by weight esterified copolymer of at least one generally linear α-olefin of from about 18 to about 50 carbon atoms and maleic anhydride in an α-olefin to maleic anhydride molar ratio of from about 4:1 to about 1:2, the copolymer having a weight average molecular weight of from about 2,000 to about 20,000, the esterified copolymer having been esterified with a plurality of aliphatic alcohols having from about four to about forty carbon atoms, imparts to the fuel oil surprisingly improved low temperature fluidity, provided that the alcohols include an eight carbon alcohol making up from about 50 to about 85 molar percent of the alcohols.

21 Claims, No Drawings

METHODS AND COMPOSITIONS FOR IMPROVEMENT OF LOW TEMPERATURE FLUIDITY OF FUEL OILS

BACKGROUND OF THE INVENTION

1. Field of the Invention

The present invention relates to improvement of low temperature fluidity of fuel oils, and more particularly to chemical treatment of fuel oils to improve their low temperature fluidity.

2. Description of the Prior Art

Upon encountering low temperatures, fuel oils tend to develop fluidity problems. In particular, paraffins in the fuel agglomerate at low temperatures to form a waxy semi-solid or gel-like material that plugs pipes and filters, inhibiting transmission of the fuel to, for example, an engine.

Conventionally, this problem is treated by adding to the fuel a chemical composition called a low temperature fluidity modifier. The low temperature fluidity modifier can co-crystalize with or adsorb the paraffins in the fuel oil to precipitate the paraffin before agglomeration or to modify paraffin crystal growth so that the resulting irregularity in size and shape of the crystals inhibits agglomeration or efficient packing of the crystals, thereby reducing the tendency toward plug formation. By contrast, pour point depressants are directed simply to viscosity reduction of fluids. Thus, while studies have shown a relation between low temperature fluidity of a fuel and the pour point or cloud point of the fuel, the mechanism of low temperature fluidity modifier operation and the problem to which low temperature fluidity modifiers are directed differ significantly from those of pour point depressants. Therefore, despite the apparent relationship between low temperature fluidity and pour point, they typically require different treatments.

Because low temperature modifiers operate by affecting the crystal growth of the paraffins in the fuel being treated, the selection and composition of a low temperature fluidity modifier for a particular fuel is based on the nature of the paraffins in that fuel. For example, low temperature modifiers typically are coordinated with the paraffins in the fuel so that the solubility characteristics of the modifier added to the fuel match the solubility characteristics of the paraffins in the fuel. Thus, if a fuel contains $C_{20-24}$ paraffins that crystallize at 10° F., the modifier is typically designed to crystallize at about 10° F. as well, thereby to interfere with the crystallization of the paraffins. Accordingly, it is well known to those of ordinary skill in the art of low temperature fluidity modification to select and to adjust the array of aliphatic chain lengths to balance overall solubility based on the paraffin content of the fuel to cause the additive to precipitate out of the fuel at the desired temperature. In fact, it is common to produce esterified olefin/maleic anhydride copolymers for use in low temperature fluidity modifier additive compositions by esterifying certain olefin/maleic anhydride copolymers with an array of aliphatic alcohols having chain lengths in the range of from about four to about forty carbon atoms, and to select the distribution of aliphatic chain lengths in that range in coordination with the paraffins in the fuel as discussed above.

Despite the existence of a variety of low temperature fluidity modifiers, none provides completely satisfactory performance in all fuels. In fact, because of the disparities in the characteristics of fuel oils, particular low temperature fluidity modifiers meet with varying success from fuel to fuel. Thus, there is a continual search for ever more effective low temperature fluidity modifiers, particularly for use in various fuels.

SUMMARY OF THE INVENTION

The present invention, therefore, is directed to a novel composition useful for improvement of low temperature fluidity of fuel oils. The composition comprises from about 1 to about 40 parts by weight ethylene/vinyl acetate copolymer having a vinyl acetate content of from about 10% by weight to about 50% by weight and a weight average molecular weight of from about 2,000 to about 10,000, per 1 part by weight esterified copolymer of at least one generally linear α-olefin of from about 18 to about 50 carbon atoms and maleic anhydride in an α-olefin to maleic anhydride molar ratio of from about 4:1 to about 1:2, the copolymer having a weight average molecular weight of from about 2,000 to about 20,000. The esterified copolymer has been esterified with a plurality of aliphatic alcohols having from about four to about forty carbon atoms, including at least one eight carbon alcohol, the at least one eight carbon alcohol making up from about 50 to about 85 molar percent of the alcohols.

The present invention is also directed to a novel method for improving low temperature fluidity of fuel oils. The method comprises adding to the fuel oil an effective amount of a composition as described in the preceding paragraph.

The present invention is further directed to a novel fuel oil composition of improved low temperature fluidity comprising fuel oil and a sufficient amount of a combination of an ethylene/vinyl acetate copolymer and at least one esterified α-olefin/maleic anhydride copolymer to impart to the fuel oil improved temperature fluidity. The ethylene/vinyl acetate copolymer has a vinyl acetate content of from about 30% by weight to about 50% by weight and a weight average molecular weight of from about 2,000 to about 10,000. The esterified copolymers are selected from among esters of copolymers of generally linear α-olefins of from about 18 to about 50 carbon atoms and maleic anhydride in an α-olefin to maleic anhydride molar ratio of from about 4:1 to about 1:2, the copolymer having a weight average molecular weight of from about 2,000 to about 20,000. The esterified copolymer has been esterified with a plurality of aliphatic alcohols having from about four to about forty carbon atoms, provided that one of the alcohols is an eight carbon alcohol that is present in a concentration of from about 10% by weight to about 25% by weight based on the total composition, including at least one eight carbon alcohol, the at least one eight carbon alcohol making up from about 50 to about 85 molar percent of the alcohols.

Among the several advantages of this invention, may be noted the provision of a low temperature fluidity modifier of improved efficacy, particularly in fuels where conventional modifiers have been less effective than desired; the provision of a method for improving low temperature fluidity of fuel oils; and the provision of fuel oil compositions for improved low temperature fluidity.

DETAILED DESCRIPTION OF THE PREFERRED EMBODIMENTS

In accordance with the present invention, it has been discovered that adding to a fuel oil a composition of from about 1 to about 40 parts by weight ethylene/vinyl acetate copolymer having a vinyl acetate content of from about 10% by weight to about 50% by weight and a weight average molecular weight of from about 2,000 to about 10,000, and 1 part by weight esterified copolymer of at least one generally linear α-olefin of from about 18 to about 50 carbon atoms and maleic anhydride in an α-olefin to maleic anhydride molar ratio of from about 4:1 to about 1:2, the copolymer having a weight average molecular weight of from about 2,000 to about 20,000, the esterified copolymer having been esterified with a plurality of aliphatic alcohols having from about four to about forty carbon atoms, imparts to the fuel oil surprisingly improved low temperature fluidity, provided that the alcohols include an eight carbon alcohol making up from about 50 to about 85 molar percent of the alcohols.

The ethylene/vinyl acetate copolymer is well known for use in low temperature fluidity modifiers as well as pour point depressants. Such copolymers are described, for example, in Japanese Patent Application Kokai: Sho 54-86505 to Takeshi, Nichihara et al. and, in a low vinyl acetate content form, in U.S. Pat. No. 4,481,013 to Tack et al., bith of which are incorporated herein by reference. As noted above, the copolymer typically comprises about 10 to about 50 percent by weight vinyl acetate monomer and has a weight average molecular weight of from about 2,000 to about 10,000. Preferably, however, the vinyl acetate content is from about 30 to about 50 percent by weight and the weight average molecular weight is from about 3,000 to about 7,000.

The esterified copolymer in the additive composition is derived from esterification of an olefin/maleic anhydride copolymer of at least one generally linear α-olefin and maleic anhydride in an α-olefin to maleic anhydride molar ratio of from about 4:1 to about 1:2. Such copolymers and esters thereof are well known, as are their methods of preparation, and have been disclosed as being useful in pour point depressants. See, for example, U.S. Pat. No. 4,240,916 to Rossi, incorporated herein by reference. The generally linear α-olefin contains from about 18 to about 50 carbon atoms. By "generally linear", what is meant is that the α-olefin takes the form $CH_2{:}CH(CH_2)_xH$, wherein x is an integer from about 16 to about 48, or (less preferably) such form with minor aliphatic branching, particularly up to about five methyl or ethyl groups. The most preferred α-olefin is linear. Although it has been found that longer chain lengths are most desirable, α-olefins up to only about 30 carbon atoms are readily available. Thus, α-olefins of from about 18 to about 30 carbon atoms (x=about 16 to about 28) are preferred, with the most desirable having about 30 carbon atoms.

The molar ratio of α-olefin to maleic anhydride in the olefin/maleic anhydride copolymer may be anywhere in the range of from about 4:1 to about 1:2, although a molar ratio of about 1:1 is preferred. The olefin/maleic anhydride copolymer has a weight average molecular weight of from about 2,000 to about 20,000, preferably about 2,000 to about 20,000, more preferably about 5,000 to about 8,000, most preferably about 6,000 to about 7,000 as measured by GPC with polypropylene glycol as a reference standard.

The olefin/maleic anhydride copolymer is esterified with a plurality of aliphatic alcohols of from about four to about forty carbon atoms. The alcohols are preferably saturated, and may be linear or branched. The esterification may be carried out in any conventional manner except, however, that at least one of the alcohols is an eight carbon alcohol. The distribution of alcohols from four to forty carbon atoms is selected in the manner well known in the prior art for coordination with the nature of the paraffins in that fuel. In particular, as noted above, selection of the array of aliphatic alcohol chain lengths to balance overall solubility based on the paraffin content of the fuel to cause the additive to precipitate out of the fuel at the desired temperature is well known. Usually, the array of alcohols is a combination of aliphatic alcohols in the range of from about eighteen to twenty-six or thirty carbon atoms. For example, Alfol 20+, a mixture of 1-octadecanol (1–2% by weight), 1-eicosanol (49% by weight), 1-docosanol (30% by weight) and 1-tetracosanol (20% by weight), has been found to be an appropriate array of alcohols for preparation of a low temperature fluidity modifier in many fuels. However, it now has been found that inclusion in that array of certain eight carbon alcohols achieves the surprising advantages noted above.

A single eight carbon alcohol may be employed, but a mixture of eight carbon aliphatic alcohols may be used. Preferably the eight carbon alcohol is a branched aliphatic alcohol (with for example, one or, less preferably, two methyl or ethyl branches), especially an ethylhexyl alcohol, and optimally 2-ethylhexyl alcohol.

Complete esterification is desired, and so the alcohols are reacted with the olefin/maleic anhydride copolymer in an optimal alcohol to maleic anhydride molar ratio of about 2:1. However, complete esterification may not be achieved and levels as low as 50% may be acceptable and 80% may be typical. Thus, the alcohol to maleic anhydride molar ratio may be as low as 1:1 or higher than 2:1 (such as 3:1), although generally there is no commercial advantage to deviating significantly from 2:1.

The molar ratio of the eight carbon alcohol to the other alcohols in the esterification reaction should be about 1:1 to about 5:1, preferably about 2:1 to about 3:1, such as about 2.5:1. Thus, about 50% to about 85%, preferably about 65% to about 75%, such as about 70%, of the moles of alcohols should be one or more eight carbon alcohols, and the same percentage of the acid groups of the olefin/maleic anhydride copolymer that have been esterified are esterified with the eight carbon alcohol.

Generally, the EVA copolymer and the olefin/maleic anhydride are mixed together in a ratio of from about 1 to about 40 parts by weight ethylene/vinyl acetate copolymer per 1 part by weight esterified copolymer. Preferably, the weight ratio is from about 1:1 to about 20:1, more preferably about 3:1 to about 10:1, even more preferably about 3:1 to about 10:1. Generally, the esterified olefin/maleic anhydride copolymer is present in a concentration of from about 2% by weight to about 30% by weight, preferably from about 5% by weight to about 25% by weight, more preferably about 10% by weight to about 20% by weight, such as about 15% by weight, based on the total weight of the EVA copolymer and the esterified olefin/maleic anhydride copolymer.

A sufficient amount of the additive mixture may be added to the fuel oil of concern in a concentration sufficient to improve the low temperature fluidity of the fuel oil. Thus, as used herein, "an effective amount" of the composition is that amount that improves the low temperature fluidity of the fuel oil. Generally, such amount provides from about 50 to about 2,500 ppm by weight of the two copolymers in the fuel oil, preferably from about 100 to about 1,000 ppm by weight, such as from about 100 to about 500 ppm by weight. The additive may be incorporated into the fuel oil by any of the standard known techniques.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the example. In the examples, all percentages are given on a weight basis unless otherwise indicated.

EXAMPLE 1

Esterification of a coplymer of aliphatic $C_{30}$ olefin and maleic anhydride (1:1 molar ratio, weight average molecular weight of 6700 as determined by GPC with polypropylene glycol reference) was carried out as follows. To a clean, dry 750-gallon stainless steel reactor were added, in series, the coplymer (1,830 lbs.), Alfol 20+ (described earlier) (540 lbs.), 2-ethylhexanol (565 lbs.), a mixture of Witco 1298 Acid Soft and CF1528 G.E. antifoam (11.75 lbs.; equivalent to 1 quart per 3,000 gallon batch), and Solvent 14 (505 lbs.). The copolymer and the Alfol 20+ were maintained prior to addition at 80° C. and added at that temperature. The resulting mixture was then heated to 120° C. and held at that temperature for 0.5 hours and the heat control was set at 165° C. and the steam was throttled in 5° C. increments to 165° C. over a two-hour period. When the solvent covered the standpipe of the reactor, the solvent return line to the reactor was opened. Distilled by-product water was drained off from the decanter as necessary. After the reaction mass reached 165°–170° C., it was held there with a steady reflux for six hours or more to produce a 98.5% yield.

EXAMPLE 2

Samples of the copolymer ester prepared in Example 1, above, were mixed with a commercially available ethylene/vinyl acetate (EVA) copolymer having a vinyl acetate content of from about 30% to about 44% and a molecular weight in the range of from about 2,980 to about 6,150. Mixtures of the copolymer ester of Example 1 and the EVA copolymer were prepared at various concentrations of the copolymer ester; 5%, 15% and 30% by weight. The mixtures were tested in various fuels under standard CFPP (cold filter plugging point) procedures against the EVA copolymer with no copolymer ester added, against the EVA copolymer with corresponding concentrations of the olefin/maleic anhydride copolymer esters that were not prepared with an equivalent array of alcohols as in Example 1, above, but without the eight carbon alcohol, and against other related additives. The tables below show the results that were obtained, with the numbers referring to CFPP temperatures in ° F. and wherein Additive Concentration refers to the concentration of the noted additive in the mixture with EVA, "$C_x$ OMA" (x being a number or a range, such as 16 or 16–18) refers to a copolymer of a $C_x$ olefin and maleic anhydride and "X" means "reacted with". For Fuel A, the concentration of the mixture in the fuel was 500 ppm, for Fuel B, the concentration of the mixture in the fuel was 300 ppm, and for Fuel C, the concentration of the mixture in the fuel was 1,000 ppm.

| Fuel A (cloud point = −10° F.; CFPP = −16° F. | Additive Concentration | | |
|---|---|---|---|
| Additive | 5% | 15% | 30% |
| None[1] | −26 | −26 | −26 |
| $C_{16-18}$ OMA X cocoamine | | −32 | −36 |
| $C_{16}$ OMA X Alfol 18+ and tallowamine | | −20 | −26 |
| $C_{16}$ OMA X Alfol 20+ and tallowamine | | −20 | −20 |
| $C_{18}$ OMA X Alfol 18+ and tallowamine | | −16 | −20 |
| $C_{20}$ OMA X Alfol 20+ and tallowamine | | −16 | −12 |

-continued

| Fuel A (cloud point = −10° F.; CFPP = −16° F. | Additive Concentration | | |
|---|---|---|---|
| Additive | 5% | 15% | 30% |
| $C_{16}$ OMA X Alfol 18+ and ditallowamine | | −18 | −16 |
| Example 1[2] | −42 | −46 | −44 |

[1]EVA copolymer with no additive was used and so the additive concentration was 0. The CFPP results are shown for each concentration for comparison purposes.
[2]The copolymer ester of Example 1, above, within the scope of the invention.

| | Additive Concentration | | |
|---|---|---|---|
| Additive | 5% | 15% | 30% |
| Fuel B (cloud point = 4° F.; CFPP = −6° F.) | | | |
| None[3] | | −20 | |
| $C_{16-18}$ OMA X cocoamine | | −14 | |
| $C_{16}$ OMA X Alfol 18+ and tallowamine | | −6 | |
| $C_{16}$ OMA X Alfol 20+ and tallowamine | | −2 | |
| $C_{18}$ OMA X Alfol 18+ and tallowamine | | −6 | |
| $C_{20}$ OMA X Alfol 20+ and tallowamine | | −6 | |
| $C_{16}$ OMA X Alfol 18+ and ditallowamine | | | |
| Example 1[4] | | −20 | |
| Fuel C (cloud point = −22° F.; CFPP = −28° F.) | | | |
| $C_{16-18}$ OMA X cocoamine | | −38 | |
| $C_{16}$ OMA X Alfol 18+ and tallowarnine | | −38 | |
| $C_{16}$ OMA X Alfol 20+ and tallowamine | | −34 | |
| $C_{18}$ OMA X Alfol 18+ and tallowamine | | −38 | |
| $C_{20}$ OMA X Alfol 20+ and tallowamine | | −34 | |
| $C_{16}$ OMA X Alfol 18+ and ditallowamine | | −38 | |
| Example 1[5] | −32 | −34 | |

[3]EVA copolymer with no additive was used and so the additive concentration was 0. The CFPP results are shown for each concentration for comparison purposes.
[4]The copolymer ester of Example 1, above, within the scope of the invention.
[5]The copolymer ester of Example 1, above, within the scope of the invention.

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed is:

1. A composition useful for improvement of low temperature fluidity of fuel oils, comprising from about 1 to about 40 parts by weight ethylene/vinyl acetate copolymer having a vinyl acetate content of from about 10% by weight to about 50% by weight and a weight average molecular weight of from about 2,000 to about 10,000, per 1 part by weight esterified copolymer of at least one generally linear α-olefin of from about 18 to about 50 carbon atoms and maleic anhydride in an α-olefin to maleic anhydride molar ratio of from about 4:1 to about 1:2, the copolymer having a weight average molecular weight of from about 2,000 to about 20,000, the esterified copolymer having been esterified with a plurality of aliphatic alcohols having from about four to about forty carbon atoms, including at least one eight carbon alcohol, the at least one eight carbon alcohol making up from about 50 to about 85 molar percent of the alcohols.

2. A composition as set forth in claim 1 wherein the α-olefin contains from about eighteen to about thirty carbon atoms.

3. A composition as set forth in claim 2 wherein the α-olefin contains about thirty carbon atoms.

4. A composition as set forth in claim 1 wherein the α-olefin to maleic anhydride molar ratio is about 1:1.

5. A composition as set forth in claim 1 wherein the copolymer of the α-olefin and the maleic anhydride has a weight average molecular weight of from about 5,000 to about 8,000.

6. A composition as set forth in claim 1 wherein each of the at least one eight carbon alcohol is a branched aliphatic alcohol.

7. A composition as set forth in claim 6 wherein each of the at least one eight carbon alcohol is an ethylhexyl alcohol.

8. A composition as set forth in claim 7 wherein the at least one eight carbon alcohol is one eight carbon alcohol, namely 2-ethylhexyl alcohol.

9. A composition as set forth in claim 1 wherein the composition comprises from about 1 to about 20 parts by weight of the ethylene/vinyl acetate copolymer per 1 part by weight of the esterified copolymer.

10. A composition as set forth in claim 1 wherein the composition comprises from about 3 to about 10 parts by weight of the ethylene/vinyl acetate copolymer per 1 part by weight of the esterified copolymer.

11. A method for improving low temperature fluidity of fuel oils, comprising adding to the fuel oil an effective amount of a composition useful for improvement of low temperature fluidity of fuel oils, comprising from about 1 to about 40 parts by weight ethylene/vinyl acetate copolymer having a vinyl acetate content of from about 10% by weight to about 50% by weight and a weight average molecular weight of from about 2,000 to about 10,000, and about 1 part by weight esterified copolymer of at least one generally linear α-olefin of from about 18 to about 50 carbon atoms and maleic anhydride in an α-olefin to maleic anhydride molar ratio of from about 4:1 to about 1:2, the copolymer having a weight average molecular weight of from about 2,000 to about 20,000, the esterified copolymer having been esterified with a plurality of aliphatic alcohols having from about four to about forty carbon atoms, including at least one eight carbon alcohol, the at least one eight carbon alcohol making up from about 50 to about 85 molar percent of the alcohols.

12. A method as set forth in claim 11 wherein the α-olefin contains from about eighteen to about thirty carbon atoms.

13. A method as set forth in claim 12 wherein the α-olefin contains about thirty carbon atoms.

14. A method as set forth in claim 11 wherein the α-olefin to maleic anhydride molar ratio is about 1:1.

15. A method as set forth in claim 11 wherein the copolymer of the α-olefin and the maleic anhydride has a weight average molecular weight of from about 5,000 to about 8,000.

16. A method as set forth in claim 11 wherein each of the at least one eight carbon alcohol is a branched aliphatic alcohol.

17. A method as set forth in claim 16 wherein each of the at least one eight carbon alcohol is an ethylhexyl alcohol.

18. A method as set forth in claim 17 wherein the at least one eight carbon alcohol is one eight carbon alcohol, namely 2-ethylhexyl alcohol.

19. A method as set forth in claim 11 wherein the composition comprises from about 1 to about 20 parts by weight of the ethylene/vinyl acetate copolymer per 1 part by weight of the esterified copolymer.

20. A method as set forth in claim 11 wherein the composition comprises from about 3 to about 10 parts by weight of the ethylene/vinyl acetate copolymer per 1 part by weight of the esterified copolymer.

21. A fuel oil composition of improved low temperature fluidity comprising fuel oil and a sufficient amount of a combination of an ethylene/vinyl acetate copolymer and at least one esterified α-olefin/maleic anhydride copolymer to impart to the fuel oil improved temperature fluidity, the ethylene/vinyl acetate copolymer having a vinyl acetate content of from about 10% by weight to about 50% by weight and a weight average molecular weight of from about 2,000 to about 10,000, the at least one esterified copolymer being selected from the group consisting of esters of copolymers of generally linear α-olefins of from about 18 to about 50 carbon atoms and maleic anhydride in an α-olefin to maleic anhydride molar ratio of from about 4:1 to about 1:2, the copolymer having a weight average molecular weight of from about 2,000 to about 20,000, the esterified copolymer having been esterified with a plurality of aliphatic alcohols having from about four to about forty carbon atoms, including at least one eight carbon alcohol, the at least one eight carbon alcohol making up from about 50 to about 85 molar percent of the alcohols.

* * * * *